United States Patent [19]

Anderson

[11] 4,235,585

[45] Nov. 25, 1980

[54] PROCESS AND COMPOSITION FOR NEUTRALIZATION OF ACIDIC COMBUSTION PRODUCTS AND FOR BOILER CLEANING

[76] Inventor: Hans Christian M. Anderson, 13 Nylandsalle, Horsens, Denmark, 8700

[21] Appl. No.: 17,273

[22] Filed: Mar. 5, 1979

[30] Foreign Application Priority Data

Mar. 3, 1978 [DK] Denmark ..... 3637/78

[51] Int. Cl.[3] ..... F23J 7/00

[52] U.S. Cl. ..... 431/3; 431/4; 134/27

[58] Field of Search ..... 431/3, 4; 134/20, 27, 134/28, 39

[56] References Cited

U.S. PATENT DOCUMENTS

| | | | |
|---|---|---|---|
| 2,800,172 | 7/1957 | Romer et al. | 431/3 |

FOREIGN PATENT DOCUMENTS

| | | | |
|---|---|---|---|
| 2322668 | 11/1974 | Fed. Rep. of Germany | 431/3 |
| 2326976 | 12/1974 | Fed. Rep. of Germany | 431/3 |
| 2500683 | 7/1976 | Fed. Rep. of Germany | 431/3 |
| 2061935 | 6/1971 | France | 431/3 |
| 1434836 | 5/1976 | United Kingdom | 431/3 |

*Primary Examiner*—Joseph Man-Fu Moy
*Attorney, Agent, or Firm*—Browdy and Neimark

[57] ABSTRACT

In the combustion zone of a furnace burning sulphur-containing fuel, one introduces continuously sodium or potassium nitrate; ammonium nitrate; calcium hydroxide and/or magnesium carbonate; carbon; and ammonium carbonate.

A neutralization of acidic sulphur compounds formed by the combustion is achieved, and the boiler is kept free from soot and other deposits.

7 Claims, No Drawings

PROCESS AND COMPOSITION FOR NEUTRALIZATION OF ACIDIC COMBUSTION PRODUCTS AND FOR BOILER CLEANING

The present invention relates to a process for the total or partial neutralization of the acidic combustion products formed by combustion of sulphur-containing fuel, by continuously injecting basic substances in the combustion zone, and to an agent for use in carrying out the process.

As it is well known, sulphur dioxide and sulphur trioxide formed by combustion of sulphur-containing fuel, including oil as well as pitcoal and lignite, cause substantial damage and nuisances. This is due, for one thing, to the noxious effect of $SO_2$-containing waste gas, especially when $SO_2$ is bound by fine soot particles and, for another thing, to the fact that sulphuric acid which is found in, or formed from waste gas not only has a strong corrosive effect on furnaces and flues but also corrodes and disintegrates building materials etc., and damages the fauna in fresh water.

Sulphur-containing compounds are present in coal as well as in fuel oil and, in particular, the cheaper qualities of the latter contain substantial amounts of sulphur corresponding to more than 5% by weight of sulphur.

It is in particular in connection with the use of this comparatively cheap oil rich in sulphur that it has been attempted to find various solutions for reducing the content of $SO_2$ and $SO_3$ in waste gas.

One of the methods consists in reducing the sulphur content of oil prior to the combustion. This method is used to some extent but is rather expensive and therefore the desulphurized oil is substantially more expensive than oil rich in sulphur, which of course also applies to oil having already when recovered a low sulphur content.

Another method of preventing great quantities of sulphur oxides from being discharged into the atmosphere with waste gas consists in washing off the sulphur oxides from the waste gas with an aqueous sodium carbonate solution. This method requires, however, a complicated plant and the regeneration of the washing liquid is energy-consuming.

Attempts have also been made to reduce the quantity of acidic sulphur compounds in waste gas by injecting pulverized dolomite ($CaMg(CO_3)_2$) or magnesium carbonate directly into the flame. The use of dolomite results, however, in detrimental deposits being formed, mainly deposits of calcium sulphate, in the furnace plant, and as regards both dolomite and magnesium carbonate, only a very small portion thereof reacts in reality with the acidic sulphur compounds, as the substances pass through the flame in practically unaltered form. Consequently, it is necessary to inject very large quantities of dolomite or magnesium carbonate in order to achieve a substantial reduction of the content of acidic sulphur compounds in waste gas, for which reason the process is work-consuming and may cause disturbances in operation on account of clogging formed by powder carried along to the air shafts. For these reasons the method is not widely used.

It has now been found that it is possible to achieve an effective neutralization of the acidic products formed by combustion of sulphur by continuously injecting at the same time, according to the invention, the following compounds: (a) sodium or potassium nitrate; (b) ammonium nitrate; (c) magnesium carbonate and/or calcium hydroxide; (d) carbon; and (e) ammonium carbonate.

It goes without saying that in the above enumeration, the compounds are mentioned on account of the technical qualities of the substances in question. Thus, the term ammonium carbonate covers also the technical product "powdered ammonia" which contains substantial amounts of hydrogen carbonate and carbaminate. The word "carbon" is also used in a broad sense and covers, e.g., powdered coal including pitcoal, lignite and charcoal, and powdered coke.

The reaction mechanism resulting in the achievement of an excellent neutralizing effect are not quite elucidated but it is assumed that sulphur is primarily bound in the form of ammonium sulphate. The fact that magnesium carbonate and calcium hydroxide, when injected together with the other compounds mentioned are in a position to exert a stronger neutralizing effect than when injected alone in accordance with the known technique, may be due to the fact that by an intermediate reaction they react with the nitrates forming basic compounds including ammonia which react effectively with the sulphur oxides.

As a consequence, inter alia, of the fact that the processes which are of importance to the neutralization take place over a very broad temperature range, it is difficult to state precisely which reactions take place, and the invention is not bound to any definite theory in this respect. It has, however, to be noted that the presence of carbon together with the nitrates is of importance in order to ensure that the compounds come into adequate contact with the sulphur-containing compounds which are to be neutralized. The fact is that by the reaction between nitrate and carbon at the temperatures prevailing in the combustion zone, a reaction having a resemblance to a deflagration takes place between the compounds injected, whereby the individual particles are disintegrated, the substances being spread evenly over the combustion zone.

It is observed that the specification to Danish Pat. No. 111 335 discloses an agent for preventing sulphur deposits and corrosion in furnaces, said agent containing alkali metal nitrate, carbon and magnesium oxide. This known agent is, however, not used continuously but only, for instance, half a minute a day, as the purpose of its use is to burn down soot deposits and neutralize sulphuric acid which might be condensed in the combustion chamber or the air shafts. Thus, the use of this known agent results in no substantial reduction in the amount of acidic sulphur compounds released in the atmosphere and even if said known agent were used for continuous injection, it would not be particularly suitable for achieving an effective neutralization, as the agent does not contain ammonium carbonate which must be regarded as of great importance to the good results obtained by the process according to the invention.

The quantitative relation between the five components (a)–(e) is not critical but experiments have shown that the best results are achieved by a process which, according to the invention, is characterized in that the compounds are injected in quantities which, calculated as percentage by weight of the total amount of the compounds (a)+(b)+(c)+(d)+(e), are as follows:

(a) Sodium or potassium nitrate: 20–55%

(b) Ammonium nitrate: 7–15%

(c) Magnesium carbonate and/or calcium hydroxide: 15–40%

(d) Carbon: 1–4%
(e) Ammonium carbonate: 15–40%

The amount of said five components to be injected per hour is, of course, dependent upon the amount of sulphur burnt with the fuel per hour. It has been found that one obtains an effective neutralization by using, according to the invention, the compounds (a)–(e) in a total amount of 50–250 g per kg sulphur contained in the fuel. This is equivalent to injecting a total of 1–6 kg of the compounds (a)–(e) for each ton oil having a sulphur content of 2.5%.

It cannot be excluded that said satisfactory effect could be achieved by simultaneously injecting the compounds separately, but for practical reasons as well as for ensuring the best possible contact between the different components, it is most convenient to carry out the process using an agent which according to the invention is characterized in that it comprises a mixture of following compounds:

(a) Sodium or potassium nitrate
(b) Ammonium nitrate
(c) Magnesium and/or calcium hydroxide
(d) Carbon
(e) Ammonium carbonate.

As it appears from the above, the preferred embodiment of this agent will be characterized in that the compounds (a)–(e) are contained in the following amounts, calculated as percentage by weight:

(a) Sodium or potassium nitrate: 20–55%
(b) Ammonium nitrate: 7–15%
(c) Magnesium carbonate and/or calcium hydroxide: 15–40%
(d) Carbon: 1–4%
(e) Ammonium carbonate: 15–40%.

As it appears from the above, the agent is to be primarily used for neutralizing the acidic products formed by combustion of sulphur, in particular sulphur dioxide. Its use results further in the same advantages as those achieved by using the agent known from the above-mentioned Danish patent specification, so that the combustion chamber is kept free of soot deposits. More surprisingly, one obtains also a substantial improvement in firing economy, which can be concluded from the fact that by using the agent one obtains an increase in the carbon dioxide content of the waste gas which by far exceeds the increase which could be expected just as a result of the oxidation capacity of the agent. It may therefore be assumed that the reaction of the agent in the mixture produces certain compounds having a catalytic effect on the combustion.

As it appears, calcium hydroxide (preferably in the form of dry hydrated lime) and magnesium carbonate may replace one another in the agent in question. Experiments have shown, however, that the best results are obtained with calcium hydroxide.

The effect of the agent has been tested in particular in connection with oil-fired plants, but it goes without saying that it will also have a favourable effect in connection with combustion of coal having a substantial sulphur content. Especially when the latter combustion takes place in fluidized bed, the conditions for use of the agent will be favourable.

Although the agent contains ammonium nitrate together with carbon acting as a reducer, it can, however, be handled quite safely without danger of explosion on account of the comparatively high content in the agent of calcium hydroxide and/or magnesium carbonate and ammonium carbonate. Accordingly, when preparing the agent, carbon and nitrates should not be combined until the calcium hydroxide and/or magnesium carbonate which are inactive in relation to the reaction of the said two components have been admixed with one of these components.

It is observed that the sulphates formed by reaction of the agent with the sulphur-containing compounds in the combustion zone do not cause problems, as they are eliminated with the waste gas and do not result in the formation of any visible plume of smoke over the chimney. The sulphate-containing waste gas is substantially less detrimental to health and less corrosive than the gas produced when no neutralizing agent is used.

The process according to the invention will be illustrated by means of the following examples:

EXAMPLE 1

In a district heating station use was made of oil containing 2.5% sulphur.

An analysis of the waste gas using a Dräger pipe showed a sulphur dioxide content in the waste gas of 52 mg per $m^3$ of gas prior to the experiment.

For each ton of oil subjected to combustion, 3 kg of a mixture consisting of:

Sodium nitrate: 38% by weight
Ammonium nitrate: 11% by weight
Magnesium carbonate: 24% by weight
Carbon: 3% by weight
Ammonium carbonate: 23% by weight where supplied to the combustion zone by injection by means of secondary air.

After the beginning of the injection of this mixture, the waste gas was once more analysed and then the result was 0 mg of sulphur dioxide per $m^3$ of waste gas. Thus this experiment resulted in a very effective neutralization.

EXAMPLE 2

Also in this example the oil used contained 2.5% by weight of sulphur.

A probe was introduced in the chimney flue and by means of a vacuum pump operating at constant speed, waste gas was drawn through two bottles placed in series and containing 10% by weight of aqueous sodium carbonate solution. For each test the bubbling-through lasted for half an hour.

The tests were carried out both when the furnace burned without injection of the agent in question and when, in an amount of about 5 kg per ton of oil, there was injected an agent of following composition:

Potassium nitrate: 38% by weight
Ammonium nitrate: 11% by weight
Calcium hydroxide: 25% by weight
Carbon: 3% by weight
Ammonium carbonate: 23% by weight The sulphite content was determined, for one thing, in a sodium carbonate solution through which waste gas had bubbled for half an hour without using the agent in question (A), for another thing, in corresponding solutions through which waste gas had bubbled also for half an hour while at the same time the agent in question was injected in the flame (B), and finally, the sulphite content was determined in a corresponding sodium carbonate solution through which no waste gas was passed (C). The results were as follows:

(A) Sulphite content calculated as $SO_2$: 5.0 mg/liter
(B) Sulphite content calculated as $SO_2$: 1.7 mg/liter
(C) (blank determination): 0.3 mg/liter.

It has to be noted that circumstances under which the tests were carried out seemed to indicate that the absorption of $SO_2$ in the sodium carbonate solution had not been complete under the applied conditions. The fact, however, that the amount of $SO_2$ absorbed in the test in which the agent in question was injected is less than ⅓ of the amount absorbed when no agent was injected must be regarded as indicating that the use of the agent results in a drastic reduction of the $SO_2$ amount in waste gas.

EXAMPLE 3

This test was also carried out in a furnace placed in a district heating station where the fuel was heavy fuel oil. The oil furnace was a rotation furnace and the boiler had a yielding capacity of $1.78\times10^6$ kcal/h and a heating surface of 60 $m^2$.

The agent used had the same composition as in Example 2, and was supplied to the fire box with secondary air. In accordance with the ejector principle the powder was abosorbed and injected at the suction side of the secondary air ventilator in an amount of 3.5 kg per ton of oil.

The composition of the waste gas before and during the treatment was measured by The Technological Institute of Jutland, Århus, which inter alia made an analysis of the sulphur dioxide and sulphur trioxide content and checked the waste gas temperature.

The sulphur tioxide content was determined by extracting a partial gas current and condensing the $SO_3$ content at 73° C. with subsequent titration of the condensate with a NaOH solution. The result is given in ml of consumed NaOH solution.

The sulphur dioxide content was determined in the gas after condensing out $SO_3$ by passing the gas through two successive washing bottles containing 3% hydrogen peroxide each, wherein the sulphur dioxide was absorbed and determined quantitatively.

The tests were carried out so that, in the first place, two sets of measurements were carried out without addition of the agent. Thereafter, the continuous addition of the agent was initiated, and after half an hour two further sets of measurements were carried out. The results obtained are stated in the following table:

| | without addition analysis | | | with addition analysis | | | difference |
|---|---|---|---|---|---|---|---|
| | 1 | 2 | aver. | 3 | 4 | aver. | % |
| Sulpher dioxide ($mg/dm^3$) | 2.35 | 1.84 | 2.09 | 1.58 | 1.56 | 1.57 | −25 |
| Sulpher trioxide ($ml/m^3$) | 4 | 3.57 | 3.79 | 2 | 1.98 | 1.99 | −47.5 |
| Waste gas temperature (°C.) | 210 | 210 | 210 | 190 | 190 | 190 | −9.5 |

As it appears from the above table, the content of sulphur dioxide and sulphur trioxide in the waste gasses was reduced by 25% and 47.5%, respectively, and a notable lowering of the waste gas temperature was achieved, which must be ascribed to the fact that the agent even when used for a short period is in a position to remove a considerable amount of boiler deposits consisting mainly of soot.

It may reasonably be assumed that a greater reduction of the sulphur dioxide and sulphur trioxide content in the waste gas would have been found if the tests had been performed in a boiler coated with less deposits than was the case, as a portion of the sulphur oxides found in analyses 3 and 4 originates presumably from combustion of sulphur-containing boiler deposits released by use of the agent.

Informative tests carried out in a smaller boiler have further shown a good neutralizing capacity of, inter alia, mixtures of the following compositions:

| | 1 | 2 | 3 |
|---|---|---|---|
| (a) Sodium nitrate, % by weight: | 25 | 36 | 50 |
| (b) Ammonium nitrate, % by weight: | 15 | 9 | 7 |
| (c) Calcium hydroxide, % by weight: | 40 | 17 | 25 |
| (d) Carbon, % by weight: | 2 | 3 | 3 |
| (e) Ammonium carbonate, % by weight: | 18 | 35 | 15 |

What I claim is:

1. A process for the total or partial neutralization of the acidic combustion products formed by combustion of sulphur-containing fuel by continuously injecting basic substances in the combustion zone, characterized by performing a continuous injection of following compounds:

(a) sodium or potassium nitrate
(b) ammonium nitrate
(c) magnesium carbonate and/or calcium hydroxide
(d) carbon
(e) ammonium carbonate.

2. A process as claimed in claim 1, characterized in that the compounds are injected in quantities which, calculated as percentage by weight of the total amount of the compounds (a)+(b)+(c)+(d)+(e), are as follows:

(a) sodium or potassium nitrate: 20–55%
(b) ammonium nitrate: 7–15%
(c) magnesium carbonate and/or calcium hydroxide: 15–40%
(d) carbon: 1–4%
(e) ammonium carbonate: 15–40%.

3. A process as claimed in claim 1 or 2, characterized by using the compounds (a)–(e) in a total amount of 50–250 g per kg sulphur in the fuel.

4. A composition for use in the process according to claim 1, characterized in that it comprises a mixture of the following compounds:

(a) sodium or potassium nitrate
(b) ammonium nitrate
(c) magnesium carbonate and/or calcium hydroxide
(d) carbon
(e) ammonium carbonate.

5. A composition as claimed in claim 4, characterized in that it contains the compounds (a)–(e) in the following amounts, calculated as percentage by weight:

(a) sodium or potassium nitrate: 20–55%
(b) ammonium nitrate: 7–15%
(c) magnesium carbonate and/or calcium hydroxide: 15–40%
(d) carbon: 1–4%
(e) ammonium carbonate: 15–40%.

6. A composition as claimed in claim 4 or 5, characterized in that component (c) is calcium hydroxide.

7. A composition as claimed in claim 4 or 5, characterized in that component (c) is magnesium carbonate.

* * * * *